US005664934A

United States Patent [19]

Schaede et al.

[11] Patent Number: 5,664,934

[45] Date of Patent: Sep. 9, 1997

[54] STACKING BOARD FOR DEPOSITING A STACK OF SHEETS, AND AUTOMATIC HANDLING APPARATUS FOR STACKING BOARDS OF THIS TYPE

[75] Inventors: Johannes Georg Schaede, Wuerzburg; Thilo Fritsche, Obernburg, both of Germany

[73] Assignee: De La Rue Giori S.A., Switzerland

[21] Appl. No.: 560,300

[22] Filed: Nov. 17, 1995

[30] Foreign Application Priority Data

Dec. 2, 1994 [CH] Switzerland ..... 3-658/94

[51] Int. Cl.[6] ..... B65G 1/18

[52] U.S. Cl. ..... 414/799; 108/53.1; 108/53.3; 108/91

[58] Field of Search ..... 414/752, 749, 414/799; 901/16; 108/53.1, 53.3, 91

[56] References Cited

U.S. PATENT DOCUMENTS

| | | | |
|---|---|---|---|
| Re. 32,344 | 2/1987 | Wind | 108/53.3 |
| 1,934,389 | 11/1933 | Ulsh | 108/53.3 |
| 2,175,326 | 10/1939 | Thompson | 108/91 |
| 3,478,892 | 11/1969 | Lockwood | 108/91 |
| 3,888,362 | 6/1975 | Fletcher et al. | 901/16 |
| 4,226,192 | 10/1980 | Myers | 108/53.3 |
| 4,317,560 | 3/1982 | Troyer | 901/16 |
| 4,596,509 | 6/1986 | Ise et al. | 901/16 |
| 4,781,517 | 11/1988 | Pearce et al. | 901/16 |
| 5,100,286 | 3/1992 | Anderson | 901/16 |
| 5,341,748 | 8/1994 | Liu | 108/53.3 |
| 5,408,937 | 4/1995 | Knight, IV et al. | 108/53.3 |

FOREIGN PATENT DOCUMENTS

| | | |
|---|---|---|
| 0 576 336 A1 | 12/1993 | European Pat. Off. . |
| 2 661 155 | 10/1991 | France . |
| WO 94/19270 | 9/1994 | WIPO . |

*Primary Examiner*—Karen B. Merritt
*Assistant Examiner*—Douglas Hess
*Attorney, Agent, or Firm*—Kane, Dalsimer, Sullivan, Kurucz, Levy, Eisele and Richard LLP

[57] ABSTRACT

The stacking board is designed as a stackable pallet (1). This exhibits on its underside, on opposite side borders (1*a*, 1*b*), in each case two hollow feet (2) and in each case two hollow latching protuberances (4, 5) with a smaller engagement depth than that of the feet. The feet (2, 3) on each longitudinal border of the pallet are located opposite the hollow latching protuberances (4, 5) on the other longitudinal border. In this manner, when a plurality of pallets are stacked one upon the other, depending on the orientation of the pallets, a tightly packed storage stack can be produced. In the case of this storage stack, the feet of the pallet placed on top are sunk into the hollow feet of the pallet located thereabove. Alternatively, a working stack can be produced, in which case the feet of a pallet placed on top engage into the hollow latching protuberances of the pallet located therebeneath. Thus, adjacent pallets are spaced apart from one another by a predetermined distance.

5 Claims, 9 Drawing Sheets

FIG. 2
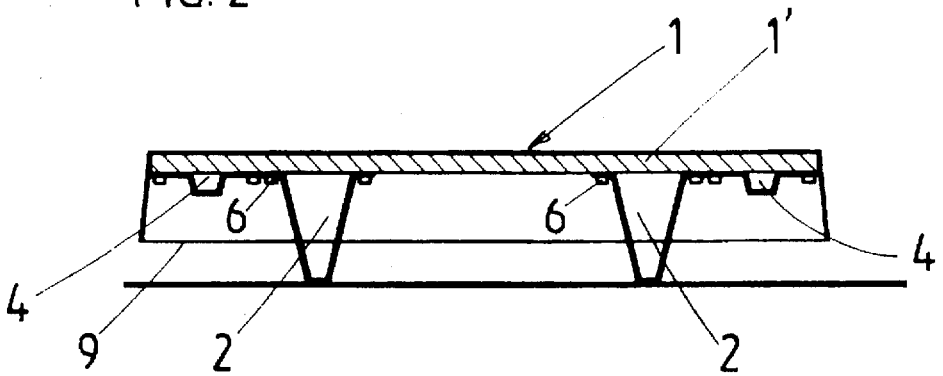
FIG.1
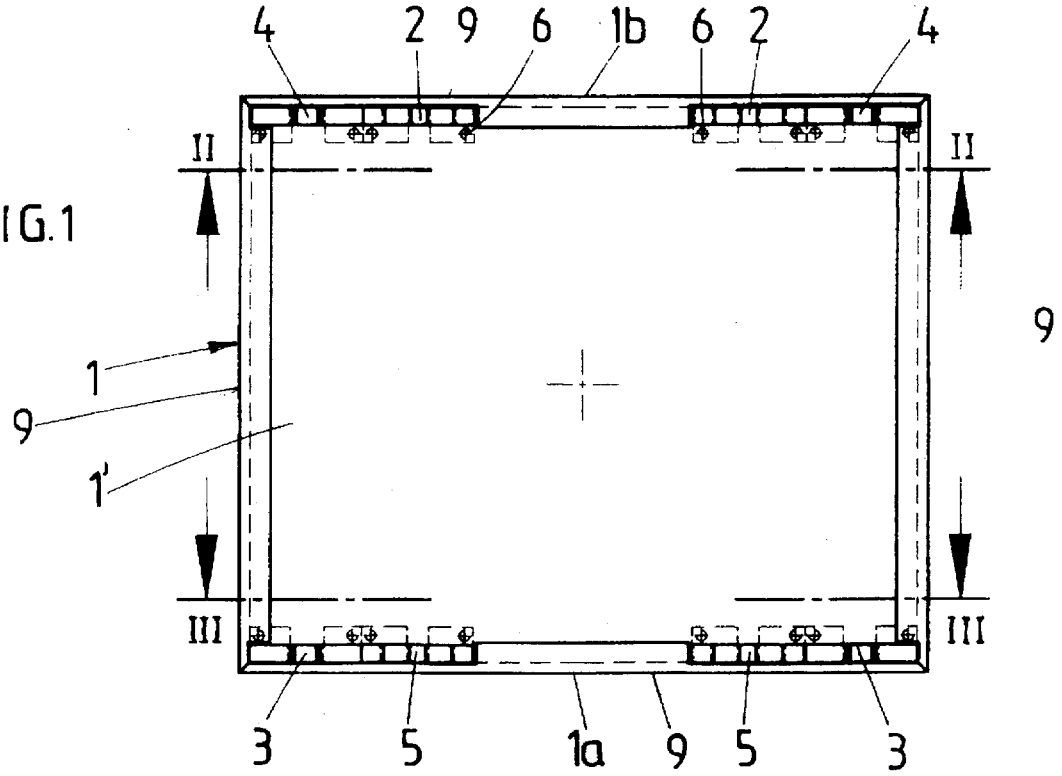
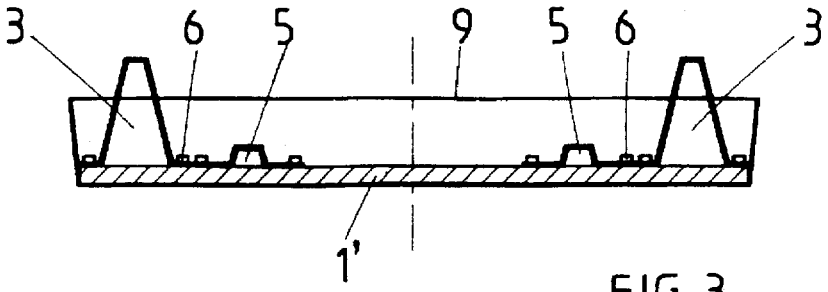
FIG. 3

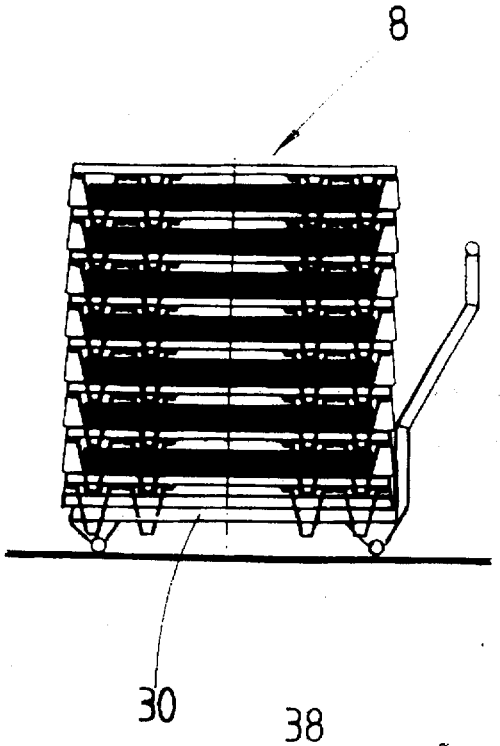
FIG. 10
FIG. 17
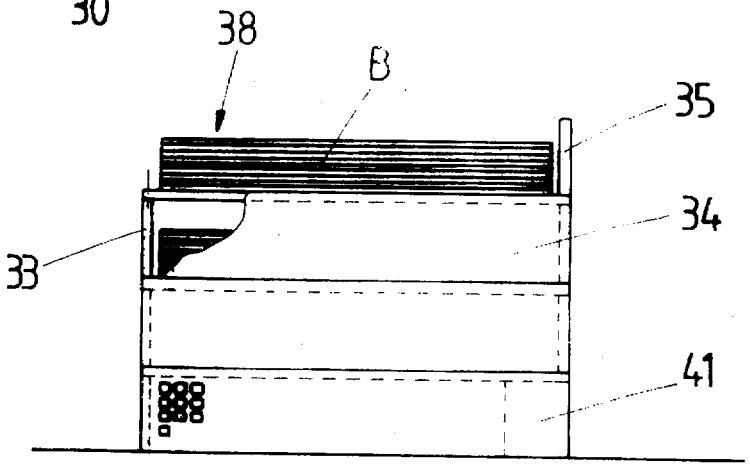
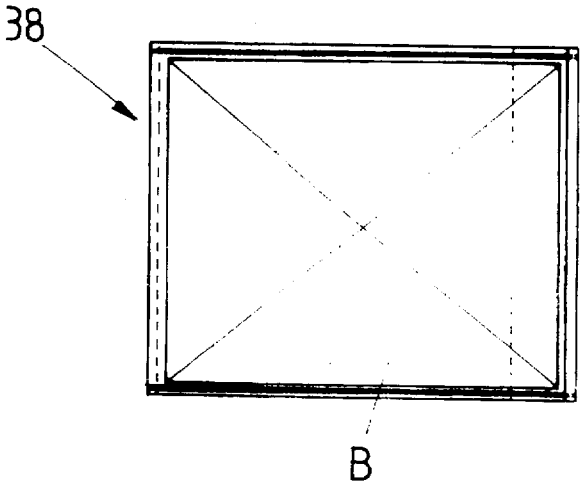
FIG. 18

FIG. 14
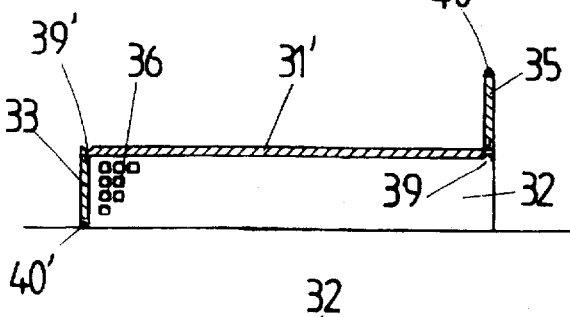
FIG. 15
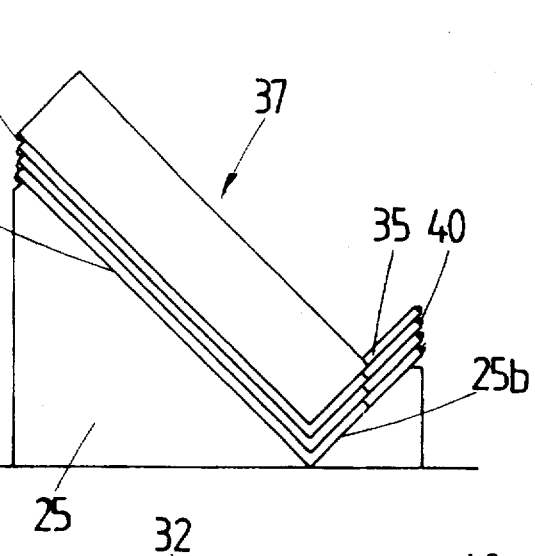
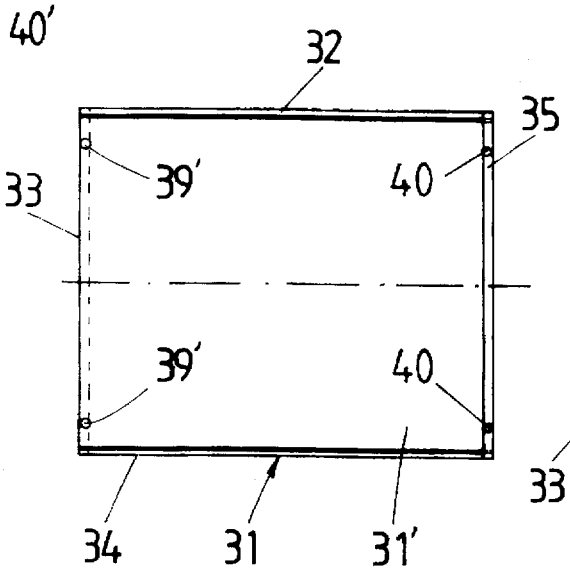
FIG. 13
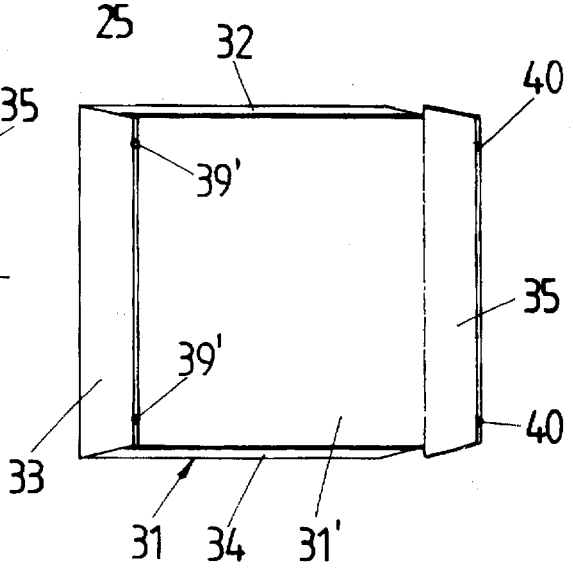
FIG. 16

31
32
37
35
34

B
31
32
35
38

STACKING BOARD FOR DEPOSITING A STACK OF SHEETS, AND AUTOMATIC HANDLING APPARATUS FOR STACKING BOARDS OF THIS TYPE

FIELD OF THE INVENTION

The invention relates to a stacking board for depositing a stack of sheets, in particular a stack of sheets of notes, and also to an automatic handling apparatus for handling stacking boards of this type.

In order to increase the cost-effectiveness, the aim in the production of notes of value, in particular bank notes, is increasingly to simplify operations and to automate said operations as far as possible. This also covers, in particular, the labor-intensive operation of manual counting, which operation ensures, after the stack of sheets have been removed, that said stack contains an exact predetermined number of sheets. However, up until now, this aim has not been satisfactorily achieved in the handling of sheets of notes leaving a printing machine. At the outlet of the printing machine, the sheets of notes, usually transported by a chain gripper system, are released above an open magazine with an adjustable bottom, and in this manner are deposited one above the other to form a stack of sheets and are then transported away in stacks for further processing. In order to avoid interruption to the printing operation when a stack of sheets has reached its predetermined height, provision is make for two magazines which are arranged one beside the other and are intended for alternately forming stacks of sheets in one and in the other magazine. Some printing processes used for printing bank notes permit only limited stack heights. This applies, in particular, for the intaglio printing process, where the stack height may be limited, in some circumstances, to 500 sheets, and also for the printing of numbering with a letterpress ink which may have long drying times.

PRIOR ART

Up until now, it has been known to produce, in each of the two magazines, a specific number of separate stacks of sheets of predetermined height with the aid of stacking boards which can be pushed into the magazine. For this purpose, the magazine has a push-in system which circulates in the manner of a paternoster lift and exhibits receiving openings which are spaced apart from one another at a predetermined distance and into which it is possible to push stacking boards which, during the depositing of the sheets of notes, are lowered at a speed appropriate for the formation of the stack of sheets. As soon as a stack of sheets on a stacking board of one magazine has reached its predetermined stack height, the following sheets of notes are redirected into the second magazine, and a new stacking board is pushed in the first magazine above the stack of sheets which has just been formed; after completion of the stack of sheets in the second magazine, the following sheets once again pass into the first magazine, onto the new stacking board, etc. The main disadvantages here are that the stacking boards have to be fitted manually into the push-in system of the magazine and also have to be removed manually after completion of the stacks of sheets. For further handling, the stacking boards provided with complete stacks of sheets, moreover, have to be stowed individually in special racks because, when a plurality of stacking boards provided with stacks of sheets are stacked directly one upon the other, on the one hand such a stacking-board stack would not be stable and, on the other hand, the stack of sheets would be compressed in an inadmissible manner.

The object of the present invention is to design a stacking board for receiving a stack of sheets such that the stacking boards can be stacked directly one above the other, and that a plurality of stacking boards, stacked one above the other and each provided with a stack of sheets, can be transported, in particular removed from a magazine and fed to another processing station as a whole unit, without the stack of sheets located on a stacking board being loaded by the weight of the stacks located thereabove; moreover, the intention is that the stacking boards according to the invention should take up only a small amount of space when they are not in use or are in the storage position. Finally, the intention is that the stacking board according to the invention should be particularly well suited for automatic handling.

SUMMARY OF THE INVENTION

This object is achieved for the stacking board according to the invention by the features specified in the defining part of claim 1.

In this manner, on the one hand, a working stack can be produced, in the case of which working stack the distance between adjacent carrying panels is greater than the thickness of a stack of sheets deposited thereon, and, on the other hand, a closely packed storage stack can be produced, the height of which storage stack only increases approximately by the thickness of a carrying panel when a pallet is added. No additional elements of any kind are necessary in order to form either of these stacks.

A special embodiment is described in claim 2, the supporting elements comprising hollow feet and hollow latching protuberances. In order, during the handling of sheets of notes, to prevent the possibility of individual sheets of notes being removed without authorization from a working stack of pallets, the pallets are preferably provided on their borders with downwardly projecting securing strips which bar access to the stack of sheets located therebeneath.

The pallets are preferably designed as is described in claim 4. In this arrangement, in the case of a working stack, the walls form the securing strips and, at the same time, the supporting elements. In this manner, the sheets located in a pallet stack are protected against unauthorized removal. Ventilation openings may be provided in the wall.

Automatic handling apparatuses for handling pallets according to the invention are defined by the features specified in the patent claims 8 to 10.

BRIEF DESCRIPTION OF THE DRAWINGS

The invention will be explained in more detail with reference to the drawings of exemplary embodiments, in which drawings:

FIG. 1 shows a plan view of a pallet in accordance with a first embodiment according to the invention, FIG. 2 shows a section through the pallet along II—II according to FIG. 1, FIG. 3 shows a section through the pallet along III—III according to FIG. 1, FIG. 10 shows the view of the transport carriage loaded with a complete working stack, FIG. 13 shows a plan view of the pallet according to FIG. 11, FIG. 14 shows a section through the pallet according to FIG. 13, FIG. 15 shows the side view of a plurality of pallets, laid one upon the other to form a storage stack, according to FIGS. 11 to 14, FIG. 16 shows a plan view of the storage stack according to FIG. 15, FIG. 17 shows, partly in section, three pallets, arranged one above the other to form a working stack, in accordance with the second embodiment, FIG. 18 shows a plan view of the working stack according to FIG. 17.

DESCRIPTION OF THE PREFERRED EMBODIMENTS

Figure 4:
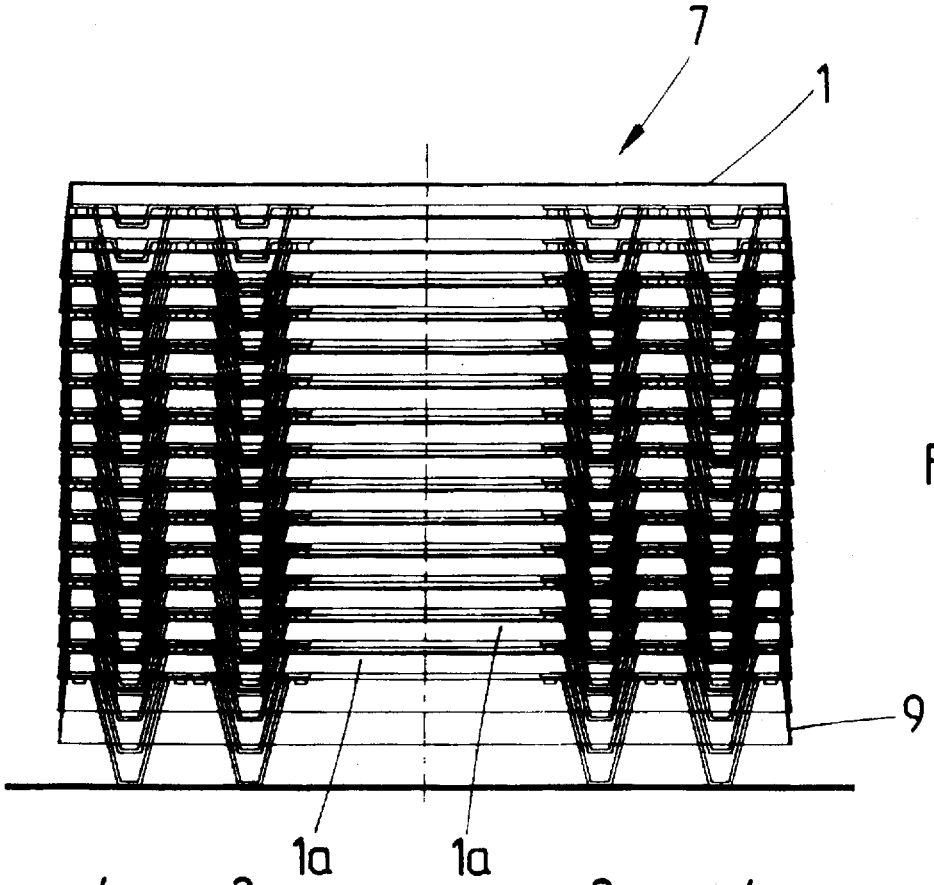
FIG. 4 shows the side view of a closely packed storage stack comprising fifteen pallets.

The stacking board represented in FIGS. 1 to 3 is in the form of a pallet 1 having a rectangular carrying panel 1' for receiving the sheets of notes to be stacked. The size of said carrying panel is adapted to the dimensions of a sheet of notes B, as is indicated in the plan view according to FIG. 7. Fastened, by means of screws 6, on opposite longitudinal borders 1*b* and 1*a* of the carrying panel 1 are in each case two hollow feet 2 and 3, which project on the underside of the carrying panel, and in each case two hollow latching protuberances 4 and 5, which likewise project on the underside of the carrying panel. The hollow feet 3, which are fastened on the longitudinal border 1*a* at the same distance from the corners of the carrying panel, are located opposite the hollow latching protuberances 4 on the other longitudinal border 1*b*, while the hollow latching protuberances 5, which are respectively fastened on the longitudinal border 1*a* at a distance from the hollow feet 3, are located opposite the hollow feet 2 on the other longitudinal border lb.

The hollow feet 2, 3 are designed to be open at the top and conical, such that the feet of another pallet can engage therein. The hollow latching protuberances 4, 5, the length of which is only a fraction of the length of the hollow feet 2, 3, are likewise designed to be open at the top and conical, such that either the end of the hollow foot or a hollow latching protuberance of a pallet placed on top can engage into a hollow latching protuberance 4, 5.

Securing strips 9 which jut out downwards and are directed obliquely outwards are preferably fitted on all four borders of the pallet, the significance of said securing strips being explained below and the securing strips themselves being represented as transparent in the figures.

The described arrangement of the hollow feet and of the hollow latching protuberances such that the hollow feet along one longitudinal border of a pallet 1 are located opposite the latching protuberances on the other longitudinal border of said pallet, and vice versa, makes it possible to form two different pallet stacks. If pallets 1 are stacked one above the other such that all the borders 1*a*, and thus also all the borders 1*b*, are located one above the other and thus all the feet of a pallet placed on top can be pushed into the hollow feet of the pallet located therebeneath and, at the same time, all the latching protuberances of one pallet engage into the hollow latching protuberances of the pallet located therebeneath, this produces a closely packed storage stack 7, as is represented in FIG. 4. In this pallet stack, which, in the example in question in FIG. 4, comprises fifteen pallets 1, the carrying panels 1' of all the pallets are located virtually one upon the other, with the result that said storage stack takes up the smallest possible amount of space. For this purpose, it is, of course, necessary for the lengths of the feet 3, 4 and the lengths of the latching protuberances 4, 5, and thus their engagement depths, to be dimensioned such that, when the pallets are stacked one upon the other, feet and latching protuberances can be sunk, by means of their entire length projecting on the pallet underside, into the feet and latching protuberances of the pallet located therebeneath.

Figure 5:
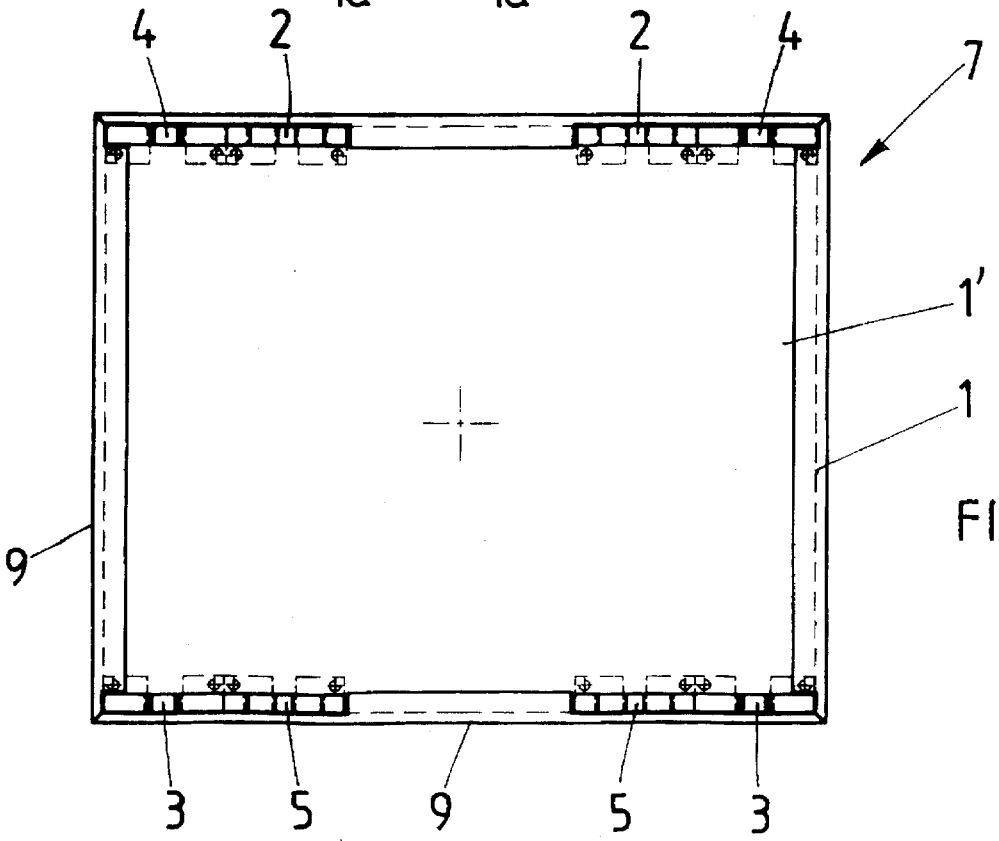
FIG. 5 shows a plan view of the storage stack according to FIG. 4.
Figure 7:
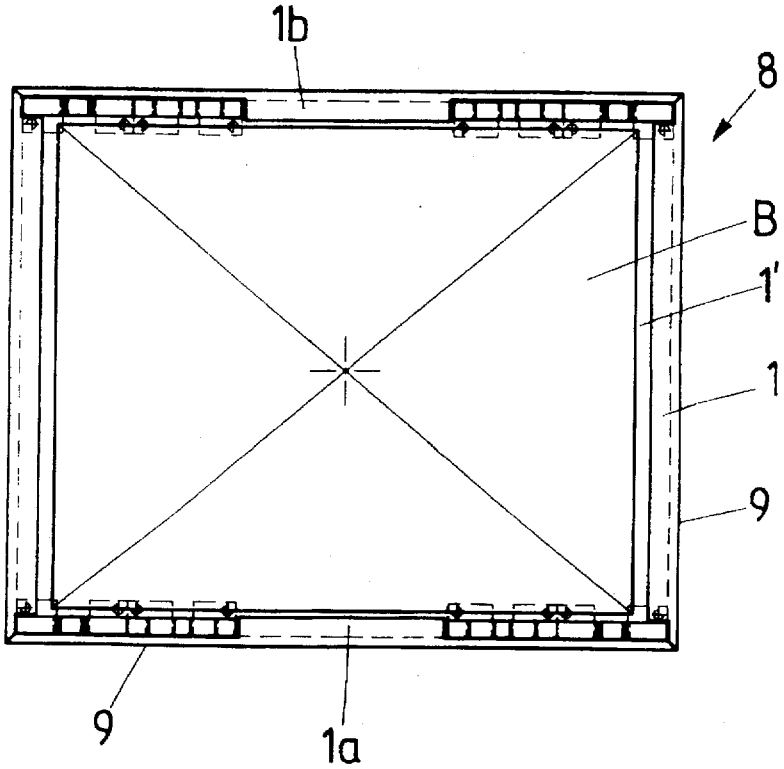
FIG. 7 shows a plan view of the working stack according to FIG. 6.

If, on the other hand, the pallets 1 are stacked such that every second pallet is placed on top such that it is rotated through 180°, with respect to the storage stack 7, that is to say such that a longitudinal border 1*b* is located above a longitudinal border 1*a* in each case, and vice versa, then the feet 2, 3 of one pallet can engage in each case into the hollow latching protuberances 4, 5 of the pallet located therebeneath, as a result of which a working stack 8 according to FIG. 5 is produced. Said working stack has eight pallets, of which the lower seven pallets according to FIG. 7 are each provided with a stack of sheets S and the uppermost pallet serves only as a cover.

The carrying panels 1' of the pallets are spaced apart from one another by a predetermined distance which is determined by the difference between the length of the hollow foot 2, 3 and the merely small depth by which a foot end engages into a latching protuberance of the pallet located therebeneath. This distance between the pallets 1 in a working stack 8 is adapted to the height of a stack of sheets S which is to be deposited on a pallet, such that a small clearance remains between the uppermost sheet B of a stack S and the panel of the pallet located thereabove; all the stacks of sheets S are thus fully relieved of the weight of the pallets and stacks of sheets located thereabove. The weight of a stack of sheets is thus transmitted by the feet of one pallet to the feet of the pallet located therebeneath. The stack of sheets S which is to be deposited on a pallet may comprise, for example, 500 sheets of notes B.

The latching of the foot ends into the hollow latching protuberances 4 and 5 produces the self-supporting, extremely stable and inherently virtually rigid pallet stack which, as a working stack 8, can be simply manipulated as a whole unit from which it is not possible to remove individual items, that is to say it can, for example, be raised up, displaced or set down on a transport carriage 30 (FIG. 10).

Figure 6:
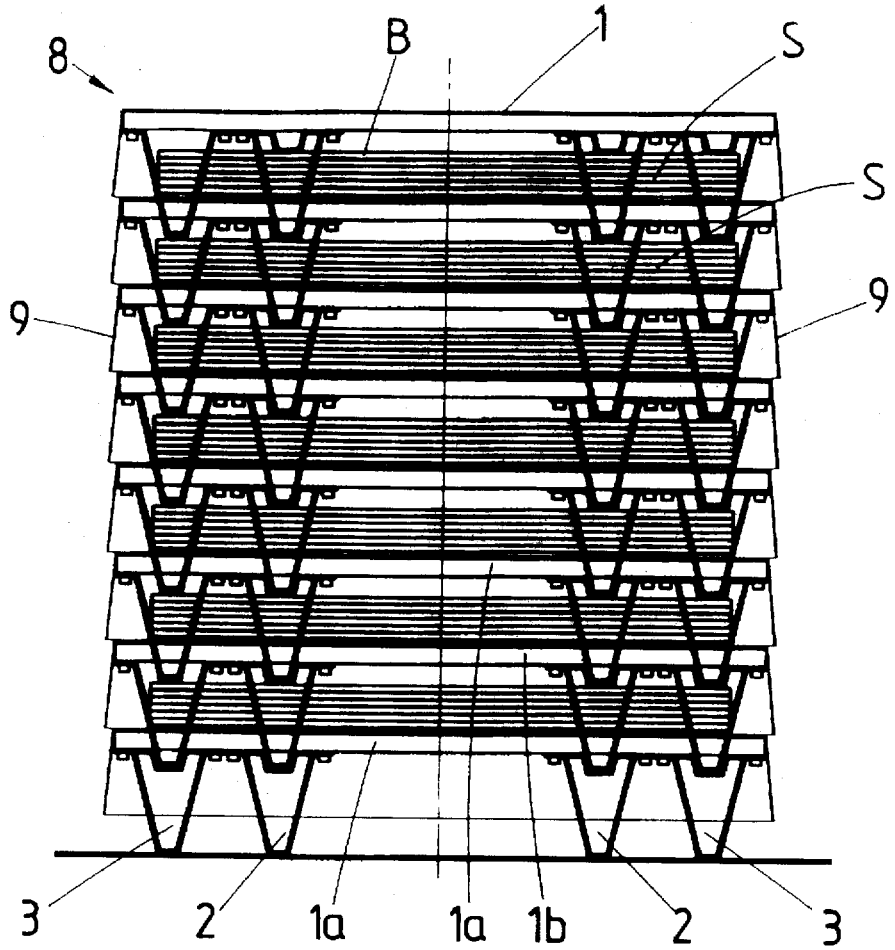
FIG. 6 shows the side view of a working stack comprising seven pallets, each provided with a stack of sheets, and an uppermost, eighth pallet.

In a working stack 8 (FIGS. 6 and 10), the mentioned securing strips 9 of a pallet 1 cover the sides of the stack of sheets on pallets located therebeneath and thus prevent the possibility of sheets of notes being drawn out laterally with fraudulent intent. The uppermost stack of sheets S on the seventh pallet is protected by the securing strips of the uppermost, eighth pallet. In a storage stack 7 (FIG. 4), the securing strips engage over one another, due to their outwardly directed inclination, and thus permit close packing.

Figure 8:
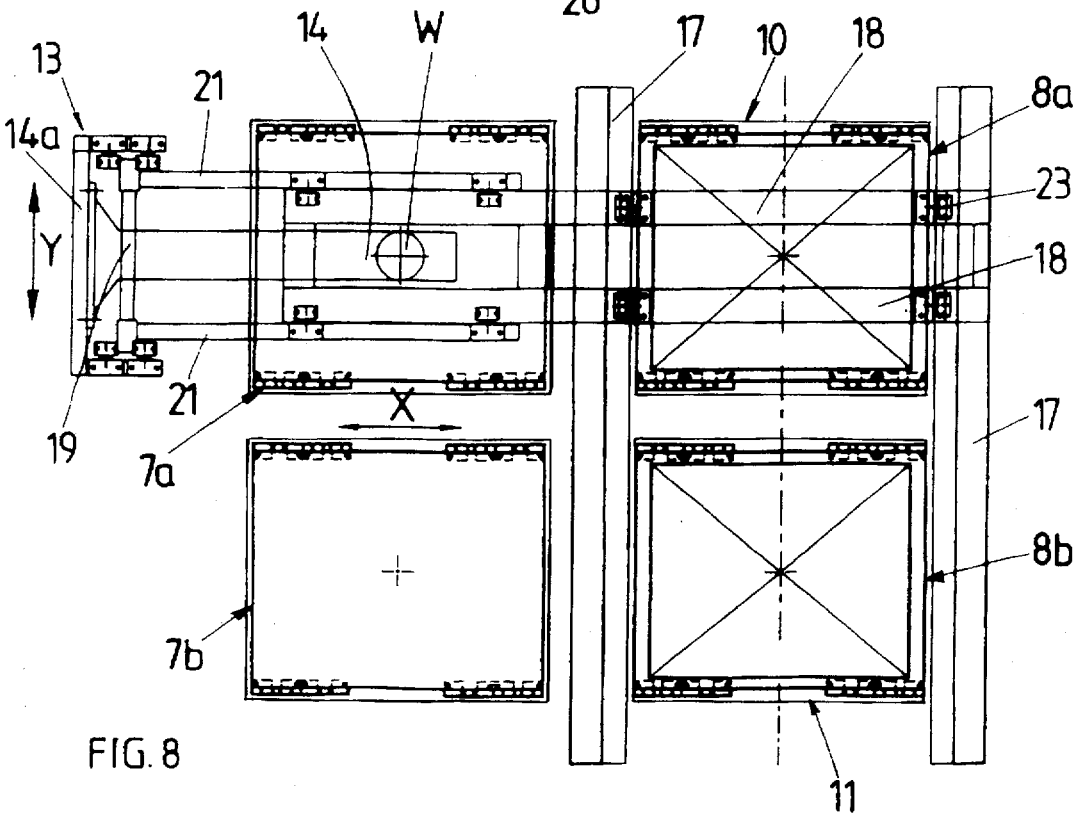
FIG. 8 shows a schematic plan view of two magazines which are arranged one beside the other, operate with pallets according to the invention and are intended for the alternating deposition of stacks of sheets of notes, on two storage stacks of pallets arranged to the sides of said magazines, and Of an automatic handling apparatus for said pallets.
Figures 11, 12:
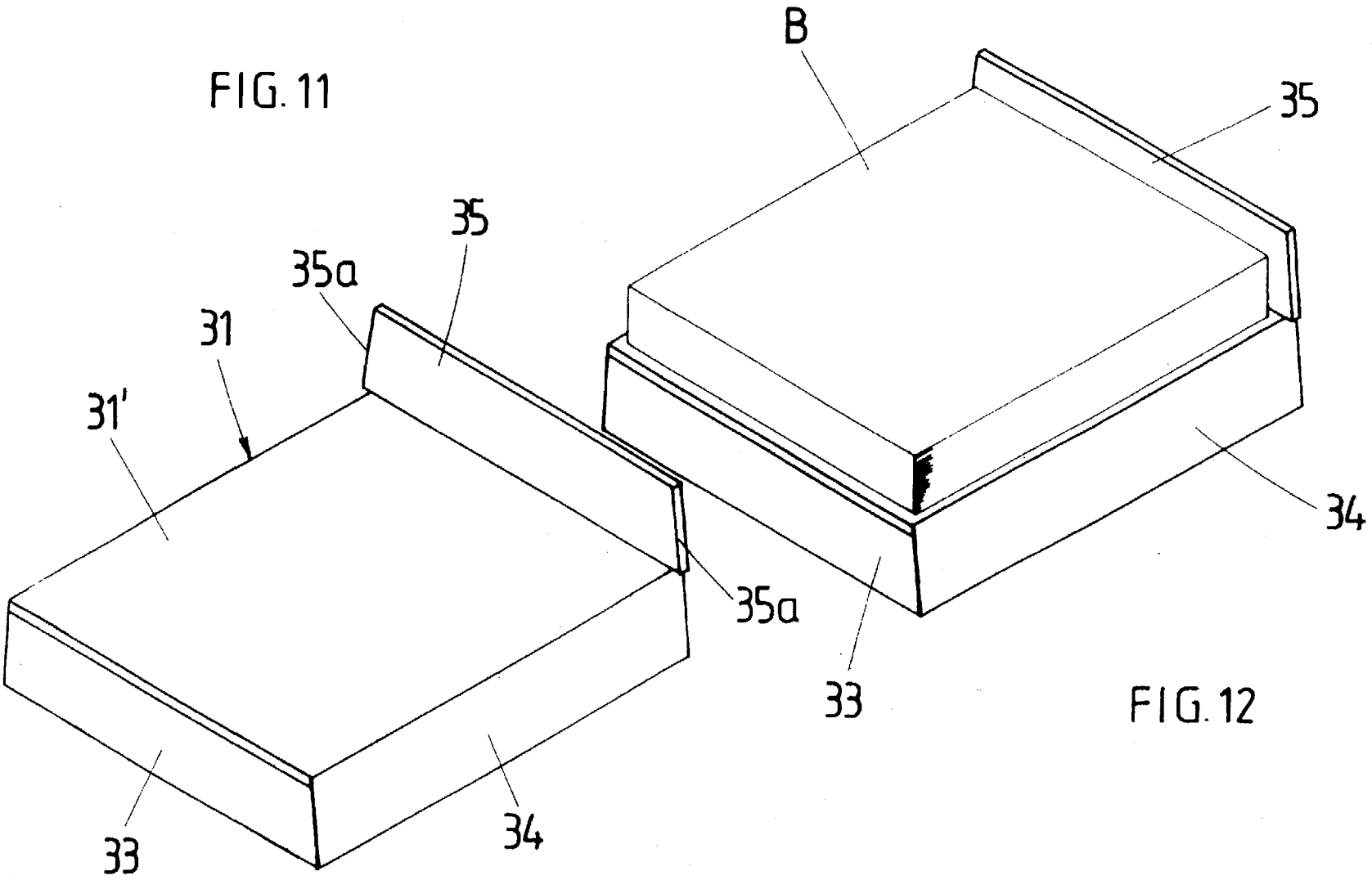
FIG. 11 shows a perspective view of a pallet in accordance with the second embodiment.
FIG. 12 shows the same pallet with a stack of sheets deposited thereon.
Figures 19, 20:
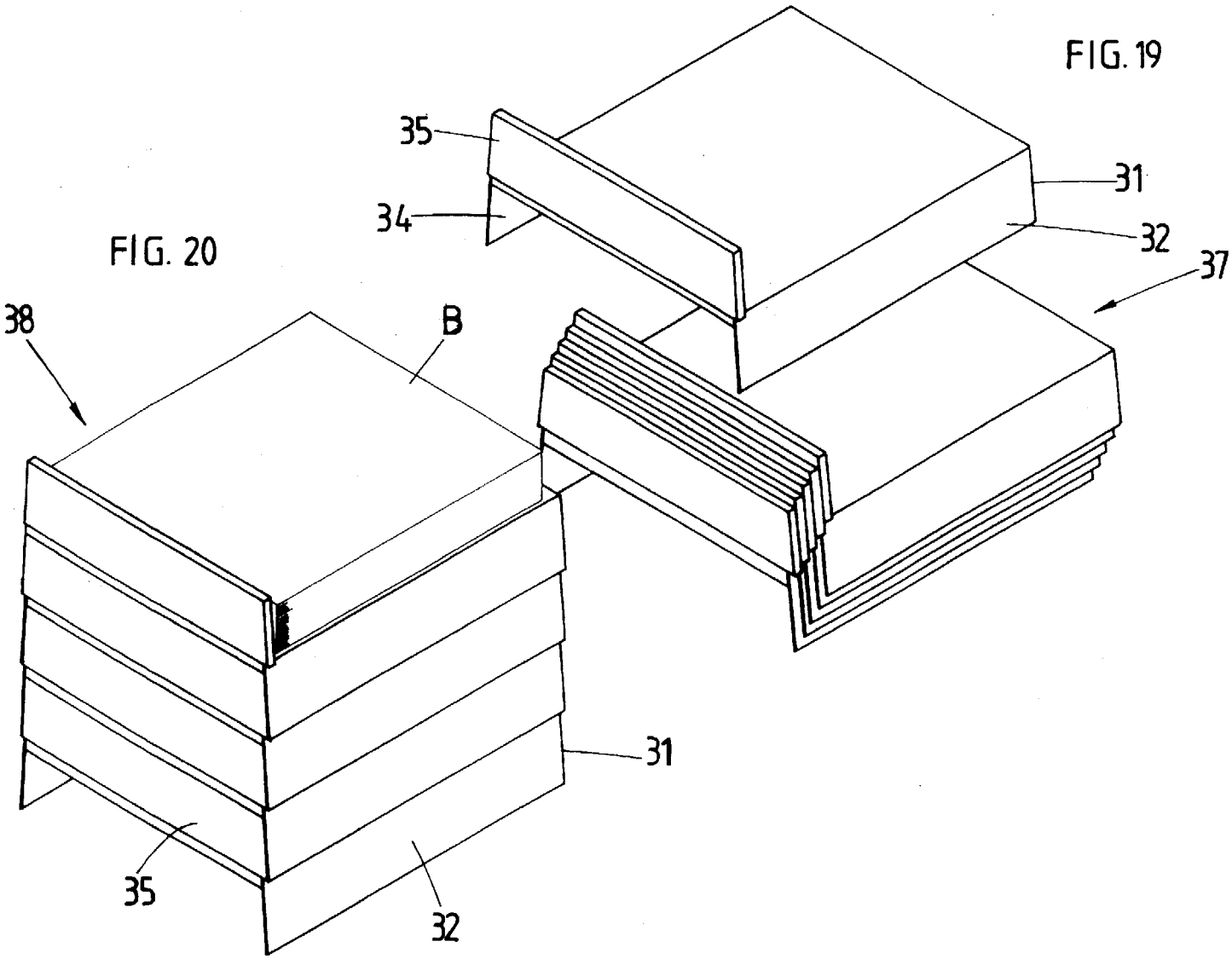
FIG. 19 shows a perspective representation of a storage stack.
FIG. 20 shows a perspective representation of a working stack of pallets in accordance with the second embodiment.

FIG. 8 shows, schematically, the plan view of two magazines 10 and 11 which are located one beside the other and are intended for depositing printed sheets of notes on pallets, which are laid one above the other in each magazine to form a working stack 8*a* and 8*b*, respectively. The sheets of notes are transported, by means of a chain gripper system 12 (FIG. 9), to above the two magazines 10 and 11 from a printing or numbering machine and are released by the grippers optionally above one of the magazines, with the result that they drop onto the uppermost pallet in order to form a stack in one of the magazines. The incoming sheets of notes move, in the representation according to FIG. 8, such that they enter from above.

There is space for two pallet storage stacks 7*a* and 7*b* to the sides of the magazines 10 and 11. Moreover, an automatic handling apparatus 13 having a carrying arm 14 is indicated schematically, which carrying arm 14 can be displaced along two horizontal, mutually orthogonal directions X and Y and along the vertical direction Z and, moreover, can be rotated about a vertical axis W arranged in the center of the carrying arm 14.

For this purpose, the automatic handling apparatus exhibits a framework. Said framework comprises vertical carriers 16 on both sides of the magazines 10, 11, two horizontal guide rails 17, which are fastened at the upper ends of the carriers 16 and run above the magazine 10, 11 on both sides, two crossmembers 18, which are arranged at right angles with respect to the guide rails 17 and extend above the magazines 10 and 11 and laterally beyond the same above the storage stacks 7*a*, 7*b*, and a vertical guide rail 19. By means of rollers 20 which are mounted on a vertical fastening plate 14*a* of this carrying arm 14, said carrying arm 14 is mounted on said vertical guide rail 19 such that it can be displaced vertically in the Z-direction. The vertical guide rail 19, for its part, is fastened on horizontal straps 21 which, by means of rollers 22, can be displaced horizontally, parallel to the X-direction, along the crossmembers 18 over the storage stacks 7*a* and 7*b* and over the magazines 10, 11. By means of rollers 23, the crossmembers 18 can be displaced, parallel to the Y-direction, along the horizontal guide rail 17. The carrying arm 14 is provided with means, with suction feet 15 in the example in question, with the aid of which a pallet of the storage stack 7*a* or 7*b* can be seized from above, raised up and manipulated in a desired manner.

That side of the magazines 10 and 11 which faces these storage stacks 7*a*, 7*b* is open to such an extent that the pallets from a storage stack can be moved laterally into the magazine 10 or 11, respectively.

By means of the described automatic handling apparatus, the carrying arms 14, and thus a pallet, can thus be moved as desired in the region of the two storage stacks 7*a* and 7*b* and of the two magazines 10 and 11.

The magazines 10 and 11 are each equipped with a lift system 25 on which the first pallet 1 which is introduced into the magazine 10 or 11, that is to say the lowermost pallet of the pallet stack to be formed, is fitted with the aid of fastening elements 26. Before the filling of the magazine begins, said first pallet is raised up into its uppermost position, in which it is only at a small distance from the chain gripper system, in order that the depth by which a sheet of notes drops when it is deposited on said pallet is only small. As the stack of sheets is formed, the pallet is constantly lowered by the lift system 25, such that the depth by which the sheets drop remains at least approximately constant.

Hereinbelow, a description is given of the handling of the pallets with the aid of the automatic handling apparatus 13, which can be controlled preferably in accordance with a predetermined program, during the filling of the magazines 10 and 11.

Expediently, the magazine 10 is filled with pallets from the storage stack 7*a* and the magazine 11 is filled with pallets from the storage stack 7*b*. In order to transport a pallet from the storage stack 7*a* into the magazine 10, the carrying arm 14 is lowered onto the uppermost pallet of the storage stack 7*a*, with the result that its suction feet 15 seize said pallet; after the suction air is activated, the carrying arm 14, with the pallet, is raised up in the Z-direction, is pushed sideways into the magazine 10 in the X-direction and is then lowered in order to set down the pallet, which is subsequently released by the suction air being deactivated. Thereafter, the carrying arm 14 is raised up and moved out of the magazine 10 horizontally in the X-direction. The transportation of a pallet from the storage stack 7*b* into the magazine 11 takes place in an analogous manner. Before a pallet is moved into a magazine, it is, if necessary, rotated through 180° about the vertical axis W into the position envisaged for the depositing position, this ensuring the formation of a working stack 8*a* in the magazine 10 and 8*b* in the magazine 11. For this purpose, it is possible to predetermine the orientation of a pallet in the storage stack and store it in the control program, or each stacking board is provided with a machine-detectable marking as regards its orientation, with the result that a required rotation of a pallet through 180° takes place on account of a corresponding control command.

Starting with two empty magazines 10 and 11, the described apparatus operates, in detail, as follows:

A first pallet is transported from the storage stack 7*a*, in the manner described above, into the magazine 10 and is fitted there, as the lowermost pallet of the working stack to be formed, on the lift system 25 with the aid of the fastening elements 26, which lift system subsequently, after the carrying arm 14 has been removed, raises said pallet up to the desired working height, in accordance with the envisaged dropping height of the incoming sheets of notes.

The transportation of the sheets of notes then begins, with the aid of the chain gripper system 12, which releases the sheets one after the other above the magazine 10. While the first stack of sheets is thus formed in the magazine 10, the carrying arm 14, once it has been displaced, horizontally in the Y-direction, out of the region of the storage stack 7*a* into the region of the storage stack 7*b*, transports the uppermost pallet of said storage stack into the magazine 11, where said pallet is fitted, as the lowermost pallet of the working stack to be formed, on the lift system with the aid of the fastening elements, which lift system subsequently raises said pallet up to the working height.

As soon as the first stack of sheets in the magazine 10 has reached the predetermined number of sheets, the magazine control means switches over to the magazine 11, with the result that the chain gripper system 12 then releases the following sheets above the magazine 11. On account of a corresponding control command, the carrying arm 14 then seizes the following pallet from storage stack 7*a*, pushes it into the magazine 10, after rotation through 180°, and sets it down on the pallet which is provided with the complete stack of sheets and which, for this purpose, has been previously lowered somewhat by the list system. Once the carrying arm 14 has been removed from the magazine 10, the working stack, comprising two pallets, in the magazine 10 is raised up into the working position by the lift system.

As soon as the first stack in the magazine 11 has reached the envisaged number of sheets, the machine control means once again switches over for deposition of the sheets onto the magazine 10, and the following empty pallet is stacked, by means of the carrying arm 14, onto the pallet, provided with a complete stack of sheets, in the magazine 11, as has been described above. On account of the control program, the automatic handling apparatus is thus respectively provided with the necessary control information as to which working stack next requires a pallet and as to the orientation of the latter. As a stack of sheets is being formed on a pallet in one of the magazines, for example in the magazine 10, the carrying arm 14, once it has set down the following pallet in the other magazine 11, already moves the next pallet in front of the magazine 10 in order that said pallet can be pushed into the magazine 10, and deposited there, immediately after the machine control means switches over to the magazine 11 or to the working stack 8*b*. This manipulation is repeated in accordance with the control program until a pallet stack of predetermined height has been produced in the two magazines 10 and 11.

A complete working stack 8 of this type can then easily be transported away as a whole unit by means of a transport carriage 30 (FIG. 10), in that, in a known manner, the platform, which can be adjusted in height relative to the wheel axles, of said carriage 30 is pushed, in the lowered position, beneath the working stack 8 and is then moved, by means of the handle which acts as a lever, into the raised-up position, in which the feet of the lowermost pallet are no longer in contact with the ground.

FIGS. 11 to 22 show a second embodiment of a pallet according to the invention and the storage stacks and working stacks formed by means of these pallets. According to FIGS. 11 to 14, the pallet 31 exhibits a rectangular carrying panel 31' which is adapted to a stack of sheets B and on which three downwardly directed lower walls 32, 33 and 34 are fastened or integrally formed on three sides and an upwardly directed upper wall 35 is fastened or integrally formed on the fourth side. The upper wall 35 and the lower wall 33 located opposite it form a right angle with the carrying panel 31', while the other two lower wails 32 and 34 run obliquely outwards. The side edges 35*a* of the upper wall 35 are bevelled such that they are adapted to the inclination of the lower walls 32 and 34 and, when a working stack 38 (FIG. 20) is formed, they can engage virtually to the full extent between the lateral ends of said obliquely running walls 32 and 34 of a pallet 31 located thereabove. Said walls 32 to 35 form, at the same time, supporting elements and the securing strips.

When a storage stack 37 (FIGS. 15 and 19) is formed, pallets 31 located directly one above the other are laid in a closely fitting manner one upon the other such that they are offset in each case by the thickness of their upper wall 35, the lower, obliquely outwardly running walls 32 and 34 of one pallet overlapping the lower, obliquely running walls 32 and 34 of the pallet located therebeneath. All the pallets 31 are thus located closely one upon the other such that they are nested one inside the other.

Figure 22:
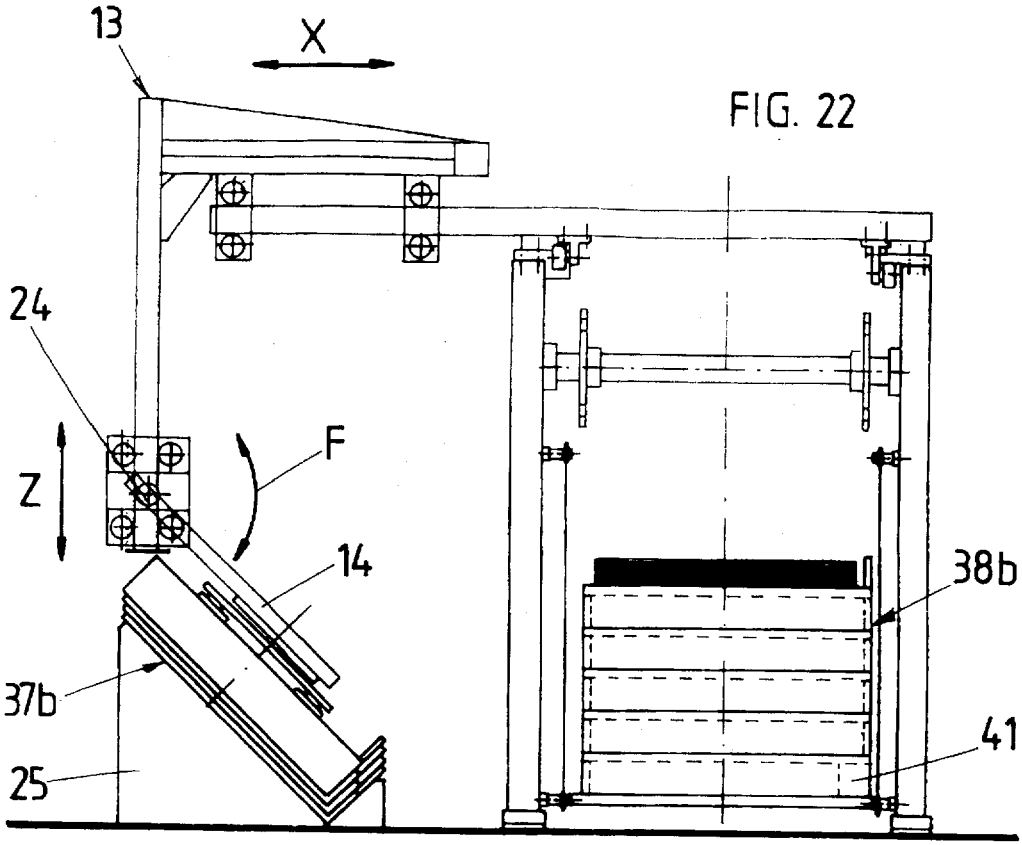
FIG. 22 shows a schematic side view of the arrangement according to FIG. 21.

It is expedient, as is represented in FIGS. 15 and 22, to provide a carrying base 25 in order to store a storage stack 37, the upper surface of which base comprises two faces 25*a* and 25*b* which run obliquely and adjoin one another at right angles, with the result that the pallets 31 can be stacked one upon the other in a tilted position, the carrying panels being located parallel one oblique face 25*a* and the upper walls 35 being located parallel to the other oblique face 25*b*.

In order to form a working stack 38 (FIGS. 17 and 20), the pallets are laid one upon the other in the same orientation as for the formation of a storage stack, but such that the pallet upper walls 35 and the pallet lower walls 33 located opposite these are each located exactly one above the other. In this arrangement, the upper wall 35 of one pallet engages between the obliquely running lower walls 32 and 34 of the pallet located thereabove, it being possible for a certain clamping effect to be provided. In a working stack 38, the upper walls 35 and the lower walls 33 located opposite these perform the actual carrying function, which ensures the stability of the stack, and all the walls 32 to 35 cover the stack of sheets to the full extent, with the result that it is not possible for any sheets to be removed.

In order to facilitate an exactly adjusted position of the pallets forming a working stack, latching elements may be provided on those surfaces of the pallets which are located one upon the other in a working stack, said latching elements being, on the one hand, latching protuberances or latching elevations and, on the other hand, corresponding latching depressions, which engage one inside the other when the stack is formed. These surfaces which are supported one upon the other are, on the one hand, those edges of the walls 33 and 35 which are parallel to the carrying panel and, on the other hand, the carrying-panel border regions which are provided in extension of said walls and are located on the carrying-panel side opposite said wall.

FIGS. 13 to 16 give schematic illustrations of examples of such latching elements (such latching elements are not represented in the other figures). Thus, latching elevations 40 may be provided on the upper edge of the upper wall 35 and corresponding latching depressions 39 may be provided on the underside of the carrying panel 31', beneath the said wall 35, the latching elevations 40 of the pallet located therebeneath engaging into said latching depressions when a working stack is formed. Instead of these latching elements, or in addition to said latching elements, it is also possible for latching elevations 40' to be provided on the lower edge of the lower wall 33 and for corresponding latching depressions 39' to be provided on the upper side of the carrying panel 31', above the wall 33, said latching elements likewise engaging one inside the other when a working stack is formed. These latching elements are, of course, arranged such that they do not obstruct the close packing of a storage stack. Thus, in the example according to FIG. 15, the elevations 40 and 40' of one pallet are located beside the border of the pallet located therebeneath. For the case where latching elevations 40' are provided on the lower edge of the wall 33, the lowermost pallet of a working stack 38, of course, rests with said latching elevations 40' on the floor or on a base. The horizontal orientation of the carrying panel of said lowermost pallet is then ensured by a correspondingly dimensioned supporting block 41 (FIGS. 17 and 22) which will be explained below.

It is also possible to provide latching depressions on the lower edge of the wall 33 and latching elevations on the upper side of the carrying panel 31' above the wall 33, with the result that the lowermost pallet of a pallet stack is supported on the lower edge of the wall 33. In order to achieve close packing of the storage stack in this case, corresponding latching depressions are also provided on the underside of the carrying panel 31', directly beside the wall 33, such that, when a storage stack is formed, the latching elevations on the upper side of one carrying panel engage in the latching depressions on the underside of a carrying panel arranged thereabove. This ensures that, in a storage stack 37, the carrying panels are located one upon the other in a closely packed manner and, at the same time, are additionally adjusted in their position by said latching elements.

In order to ensure stable seating of the lowermost pallet when a working stack is formed, a separate supporting block 41 is provided in the example in question according to FIGS. 17 and 22, which supporting block replaces the missing upper wall of a non-existent pallet located therebeneath and assumes the carrying function thereof. Of course, one could also produce a special pallet which is provided with an additional supporting element of this type beneath the upper wall and forms the lowermost pallet of a working stack in each case. However, since it is generally more cost-effective and expedient to work merely with pallets of the same configuration, the use of a separate supporting block 41 for the lowermost pallet of a working stack is generally more favorable.

Since the sheets of notes to be stacked are usually not yet fully dry, ventilation openings 36 are provided in at least one of the walls of the pallet 31, as is indicated in FIG. 14 for the lower wall 32. This aids the full drying of the sheets. Of course, ventilation openings of this type may be provided in all four walls.

Figure 9:
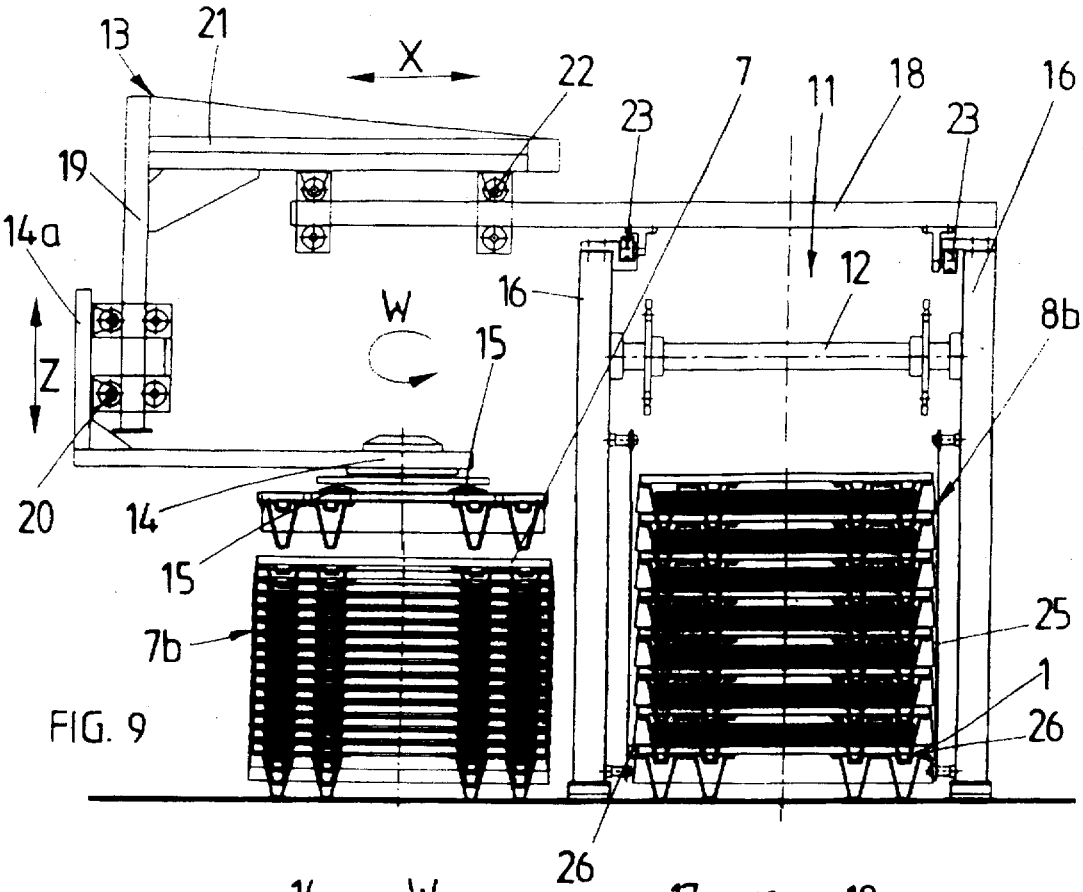
FIG. 9 shows a schematic side view of the arrangement according to FIG. 8.
Figure 21:
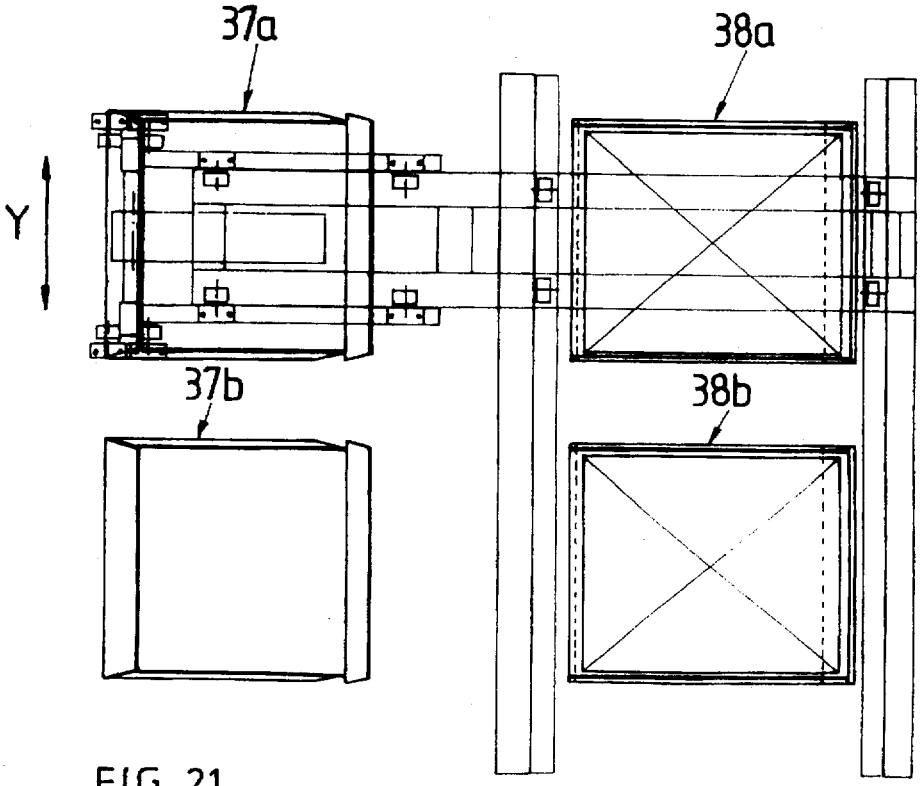
FIG. 21 shows a schematic plan view of an arrangement which corresponds to the representation according to FIG. 8 and is intended for handling the pallets in accordance with the second embodiment.

The arrangement represented in FIGS. 21 and 22 corresponds to the abovedescribed arrangement in accordance with FIGS. 8 and 9 and only differs from this due to the fact that it is adapted to the pallets 31 and to the handling of said pallets. One difference consists in the fact that, in order to support the two storage stacks **37*a* and 37*b*, provision is made for special carrying bases 25 which retain the pallets 31 in a tilted position, as has already been described for the carrying base 25 represented in FIG. 13; the second difference consists in the fact that it is possible for the carrying arm 14 not only to be displaced in the two horizontal directions X and Y and in the vertical direction Z, but also to be tilted about the horizontal axis 24 in the direction of the bent arrow F, in order that it can raise up the obliquely stored pallets from a storage stack 37*a*, 37*b* and can then tilt them into the horizontal position. For this, there is no need, in said automatic handling apparatus, for rotation about the vertical center axis, since the pallets do not have to be rotated about a vertical axis for their transportation from a storage stack onto a working stack 38*a* or 38*b*. All the rest of the components of the arrangement are the same as those of the described arrangement according to FIGS. 8 and 9, and the mode of operation is also the same as has been described above with reference to FIGS. 8 and 9**.

We claim:

1. A stacking board for depositing a stack of sheets, wherein the stacking board is designed as a stackable pallet having a carrying panel and having at least two sets of lateral support elements on surfaces and on opposite lateral borders of the pallet, said at least first set of lateral support elements are two hollow feet with a predetermined engagement step for inserting the hollow feet of another pallet and said at least second set of lateral support elements are two hollow latching protuberances with a smaller engagement step than said predetermined engagement step, and wherein the hollow feet on said one side border of the pallet are located opposite the hollow latching protuberances on said opposite side border of the pallet and are designed such that, when pallets are stacked one upon another, depending on an orientation of said pallets, either a closely packed non sheet stacking storage stack of pallets can be produced, whereby the hollow feet of one pallet engage the hollow feet of the pallet located therebeneath on said one side border and the latching protuberances of one pallet engage the latching protuberances of the pallet therebeneath on said opposite side border, or a working stack of pallets can be produced that allows sheets to be stacked on each said pallet therebetween, whereby the hollow feet of one pallet engage the latching protuberances of a pallet therebeneath on both side borders of the pallets.

2. The stacking board as claimed in claim 1, wherein the board is provided on said border with securing strips which jut out downwards and are directly obliquely outwards.

3. A stacking board for depositing a stack of sheets, wherein the stacking board is designed as a stackable pallet having a rectangular carrying panel and having lateral support elements on two opposite sides of the pallet, said support elements comprise three downwardly directed lower walls arranged on three sides of the rectangular carrying panel, and a fourth, upwardly directed upper wall arranged on the fourth side of the carrying panel, and wherein the two lower walls, which are located on the sides running at right angles with respect to the upper wall, run obliquely outwards, such that in a working stack of pallets carrying stack of sheets, the one upper wall and the three lower walls of each pallet are aligned to match with the corresponding one upper wall and corresponding three lower walls of each adjacent pallet in the stack, whereby, the upper wall of one pallet engages between the two lower obliquely running walls of the pallet located thereabove, and when the pallets are empty and being stored in a storage stack, adjacent pallets are located in a closely fitting manner one upon the other such that they are offset in each case by the thickness of the upper wall, and the two lower obliquely running walls of one pallet overlap the two lower obliquely running walls of the pallet located therebeneath.

4. The stacking board as claimed in claim 3, wherein ventilation openings are provided in at least one of the walls.

5. The stacking board as claimed in claim 4, wherein said board is provided with complementary latching elements, whereby one of the latching elements is provided on an edge of at least one of the walls oriented perpendicularly with respect to the carrying panel and the latching elements which are complementary to said first-mentioned latching elements are provided on the carrying-panel side remote from said wall, in extension of the mentioned wall, such that, when a working stack is formed, the latching elements of one pallet interengage with the latching elements of the adjacent pallets.

* * * * *